US007185482B2

(12) United States Patent
Eichhorn

(10) Patent No.: US 7,185,482 B2
(45) Date of Patent: Mar. 6, 2007

(54) DRIVE-CAPABLE SUPPORT OR TRACTION MEANS AND METHOD FOR PRODUCTION THEREOF

(75) Inventor: Roland Eichhorn, Oberkulm (CH)

(73) Assignee: Inventio AG, Hergiswil (CH)

( * ) Notice: Subject to any disclaimer, the term of this patent is extended or adjusted under 35 U.S.C. 154(b) by 428 days.

(21) Appl. No.: 10/693,384

(22) Filed: Oct. 24, 2003

(65) Prior Publication Data

US 2004/0083706 A1 May 6, 2004

(30) Foreign Application Priority Data

Nov. 5, 2002 (EP) ..... 02405946

(51) Int. Cl.
*D07B 1/02* (2006.01)

(52) U.S. Cl. ..... 57/230; 57/232

(58) Field of Classification Search ..... 57/212–214, 57/216–218, 220–223, 230, 232
See application file for complete search history.

(56) References Cited

U.S. PATENT DOCUMENTS

| | | | | |
|---|---|---|---|---|
| 4,123,894 | A | 11/1978 | Hughes et al. | 57/220 |
| 4,202,164 | A | 5/1980 | Simpson | |
| 4,344,278 | A * | 8/1982 | Jamison et al. | 57/221 |
| 4,422,286 | A * | 12/1983 | Simpson et al. | 57/221 |
| 4,438,293 | A | 3/1984 | Voser | |
| 4,602,476 | A * | 7/1986 | Riggs et al. | 57/214 |
| 4,606,183 | A * | 8/1986 | Riggs | 57/221 |
| 4,667,462 | A * | 5/1987 | Smyth | 57/217 |
| 5,566,786 | A | 10/1996 | De Angelis et al. | 187/266 |
| 5,881,843 | A | 3/1999 | O'Donnell | |
| 6,321,520 | B1 | 11/2001 | De Angelis | 57/223 |
| 6,385,957 | B2 * | 5/2002 | Misrachi | 57/221 |
| 6,412,264 | B1 * | 7/2002 | De Josez et al. | 57/217 |
| 2002/0002815 | A1 * | 1/2002 | Bertini et al. | 57/216 |

FOREIGN PATENT DOCUMENTS

| | | |
|---|---|---|
| CN | 1262358 | 8/2000 |
| EP | 0 672 781 | 9/1995 |

* cited by examiner

*Primary Examiner*—Shaun R. Hurley
(74) *Attorney, Agent, or Firm*—Klaus P. Stoffel; Wolff & Samson PC

(57) ABSTRACT

A drive-capable support or traction member and a method for the production thereof. The support or traction member has at least one layer of strands of synthetic fiber material and an outer casing encasing the strands. A lubricant is selectively incorporated in the support or traction member so that the strands are lubricated for movement relative to one another with a coefficient of friction.

31 Claims, 4 Drawing Sheets

DRIVE-CAPABLE SUPPORT OR TRACTION MEANS AND METHOD FOR PRODUCTION THEREOF

BACKGROUND OF THE INVENTION

The invention relates to a drive-capable support or traction means and a method for production thereof.

Cables of steel are known as support or traction means, where several strands of steel are laid to form a cable. In the following, support or traction means are discussed as drive-capable cables or belts for the realm of elevators. With knowledge of the invention, applications of drive-capable support or traction means are entirely possible in other technical fields, such as, for example, in cranes. In the field of elevators, support or traction means are driven by friction contact at drive pulleys or are deflected at deflecting rollers, wherein the strands are loaded in bending and tension and absorb traction forces. Cages or counterweights connected with these support or traction means are driven in this manner in elevator shafts.

The drive capability of support means is fixed in European Standard EN-81-1 in paragraph 9.3, wherein the minimum requirements read as follows: a) the cage must be held, without slipping, at a stopping point when it is loaded with 125% of the nominal load, b) in the case of emergency braking the empty cage, or cage loaded with nominal load, must be decelerated at a speed which does not lie above the design speed of the buffer, inclusive of a reduced buffer stroke, and c) the empty cage should not rise when the counterweight rests on buffers and the drive runs in an upward direction.

A cable of synthetic fiber material with the objects of reducing the weight of such support or traction means and in order to provide a largely maintenance-free support or traction means has become known from EP-0672781. In this cable, strands of aramid are laid in two layers with a lefthand start and righthand start and completely encased by an outer casing of polyurethane (PU). The outer casing is fixedly connected with the outer strand layer and has such a high bonding force relative to the outer strand layer that an introduction of the traction forces from the drive pulley through the outer casing into the outer strand layer is made possible without the outer strand layer in that case displacing or compressing. The requirements with respect to service life of drive-capable support or traction means are high, under which they shall survive at least $10^5$, if not $10^6$, bending loads. Disposed between the outer strand layers and an inner strand layer there is a friction-reducing intermediate casing which ensures a relative movement of the outer strand layer with respect to the inner strand layer during bending at the drive pulley and, through this relative movement, avoids wear, which is disadvantageous for the strands, by mutual rubbing. The intermediate casing separates the outer strand layer from the inner strand layer.

It has now proved disadvantageous in the first instance that in the case of such a drive-capable cable of synthetic fiber material the size of the coefficient of friction of the strands relative to one another is not settable in a controlled manner. EP-0672781 does indeed disclose the use of silicon as lubricant of the strands relative to one another, but diffused silicon readily escapes through the outer casing of PU or from the cable, which in turn, as soon as silicon gets on the drive pulley, limits the drive capability of the cable and thus the usability of the elevator.

Moreover, it has proved disadvantageous that an over-dimensioning of the coefficient of friction leads to development of heat or to prematurely occurring stiction, while an under-dimensioning of the coefficient of friction leads to twisting of the strands in the outer casing (cable twisting). These effects of heat development, premature stiction and cable twisting reduce the service life of the cable of synthetic fibre material.

As a solution for these disadvantages there is disclosed in U.S. Pat. No. 5,881,843 a cable for elevators in which the strands of aramid are laid in several strand layers to form a cable and are encased by an outer casing of polyamide (PA) or PU. Each of the strands is additionally protected by a strand casing of PA or PU. The coefficient of friction between the outer casing and the strand casings is greater than or equal to 0.15 and thus allows introduction of traction forces from the drive pulley through the outer casing into the strand casing of the strands of the outer strand layer, while the coefficient of friction between the strand casings is greater than or equal to 0.10 and thus facilitates movement of the strands relative to one another.

The low bonding force between the outer casing and the outer strand layer is a disadvantage of the teaching according to U.S. Pat. No. 5,881,843, whereby introduction of traction forces from the drive pulley through the outer casing into the outer strand layer is not possible without displacement or compression of the outer strand layer. The expensive production process of the cable of synthetic fiber material, where each strand is provided with a strand casing, is also disadvantageous. On the other hand, the increase in the cable diameter by the strand casing is disadvantageous, this strand casing producing a mutual spacing of the strands so that the strands cannot rub directly against one another.

SUMMARY AND DESCRIPTION OF THE INVENTION

Figure 1:
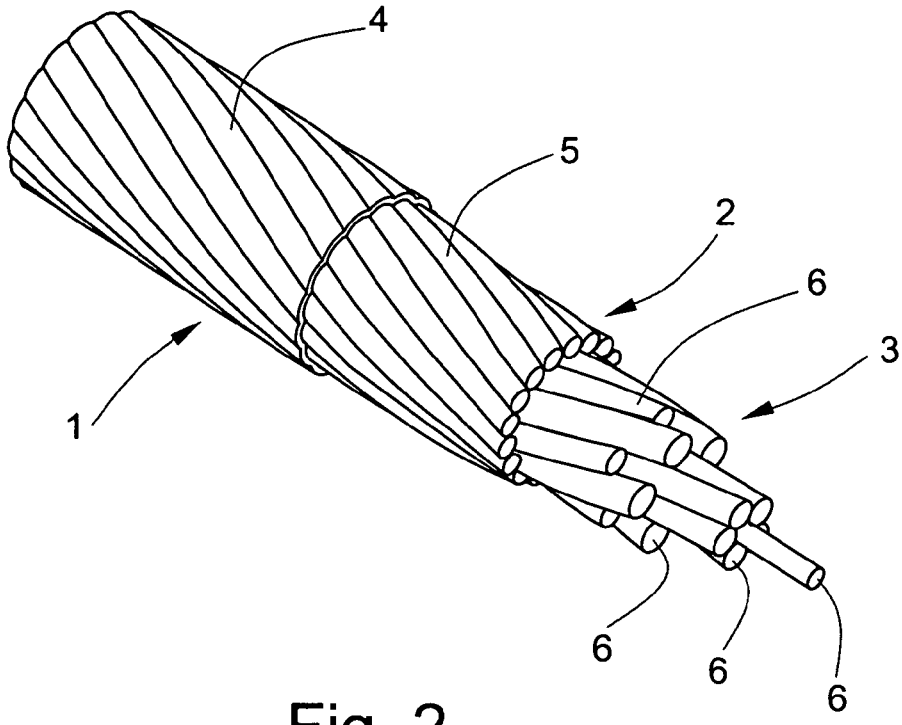
FIG. 1 is a perspective view of the inventive support and traction means.
Figure 2:
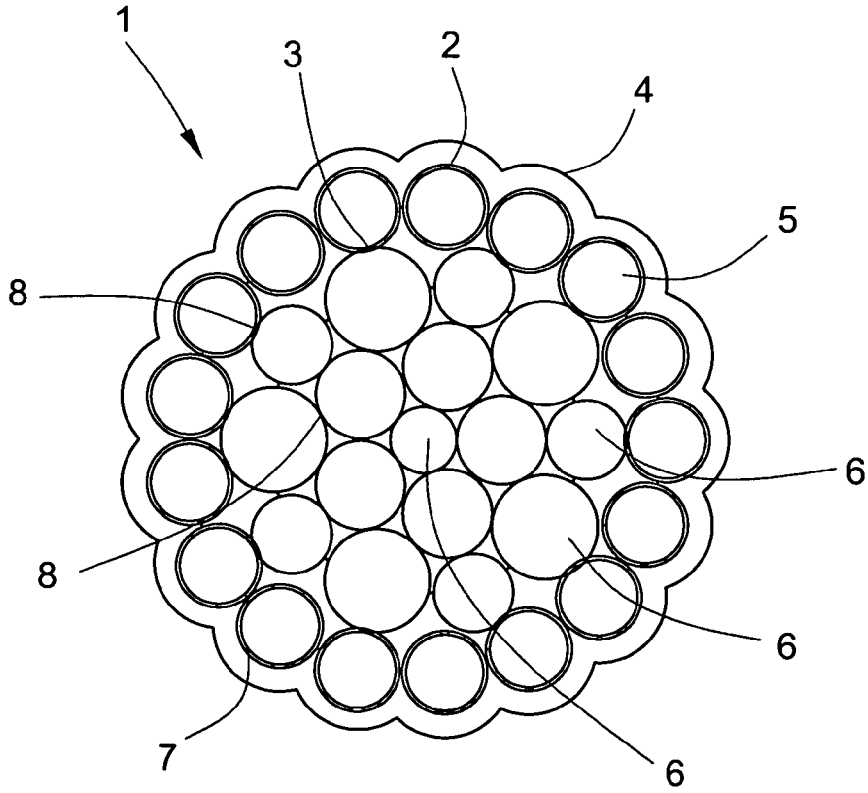
FIG. 2 is a cross-section through FIG. 1.
Figure 3:
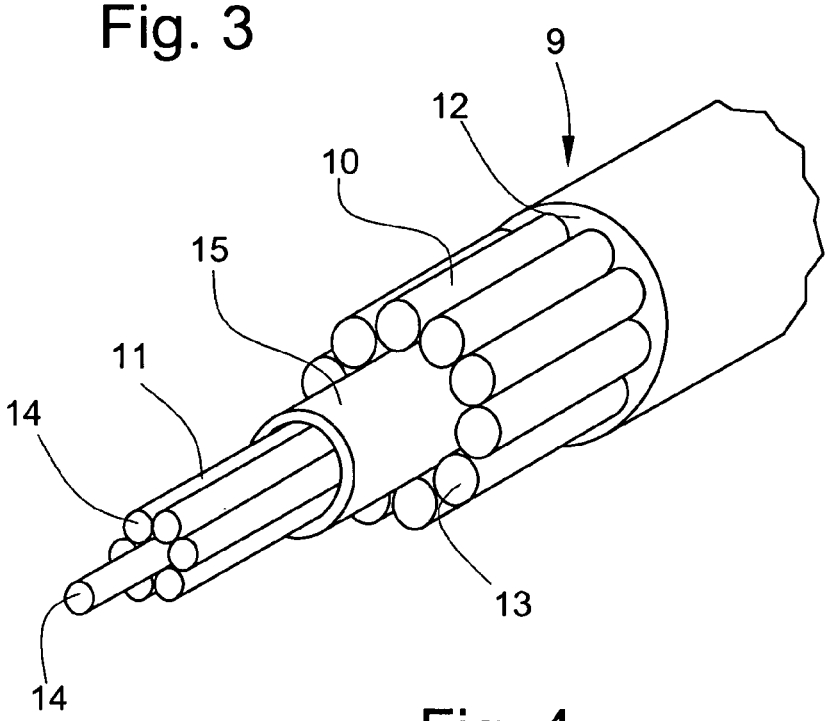
FIG. 3 is a perspective view of another embodiment of the invention.
Figure 4:
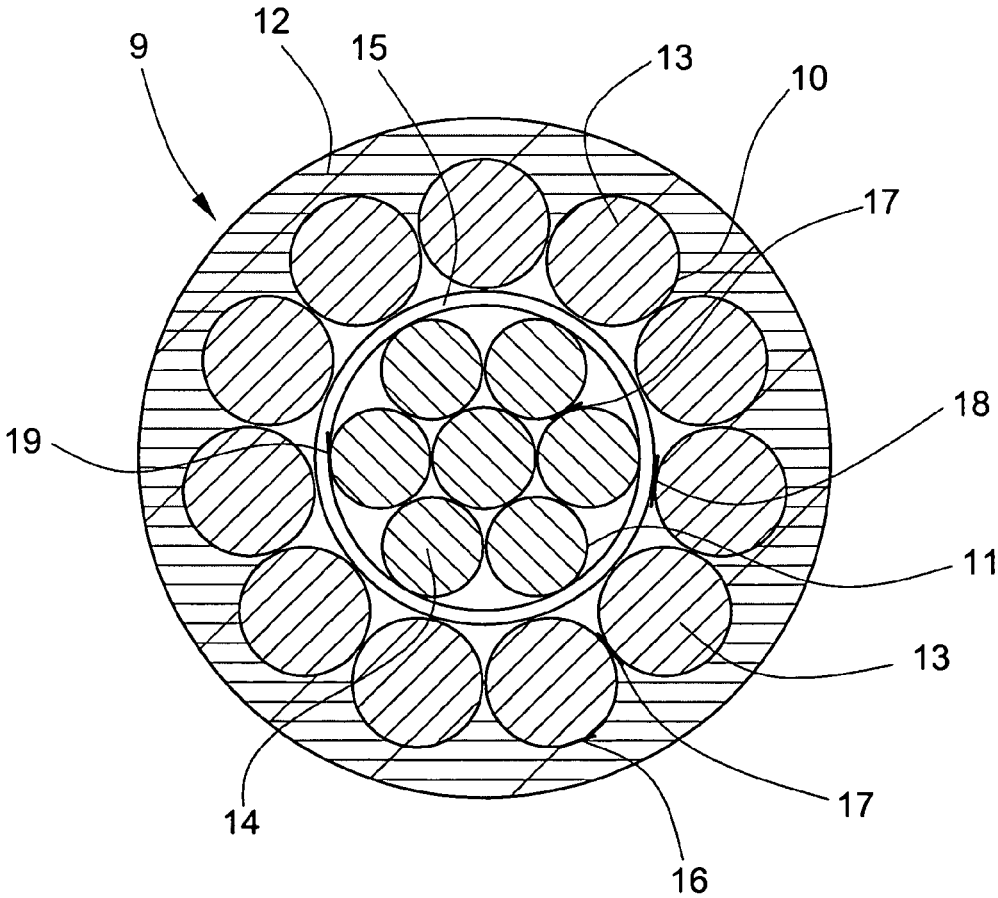
FIG. 4 is a cross-section through FIG. 3.
Figure 5:
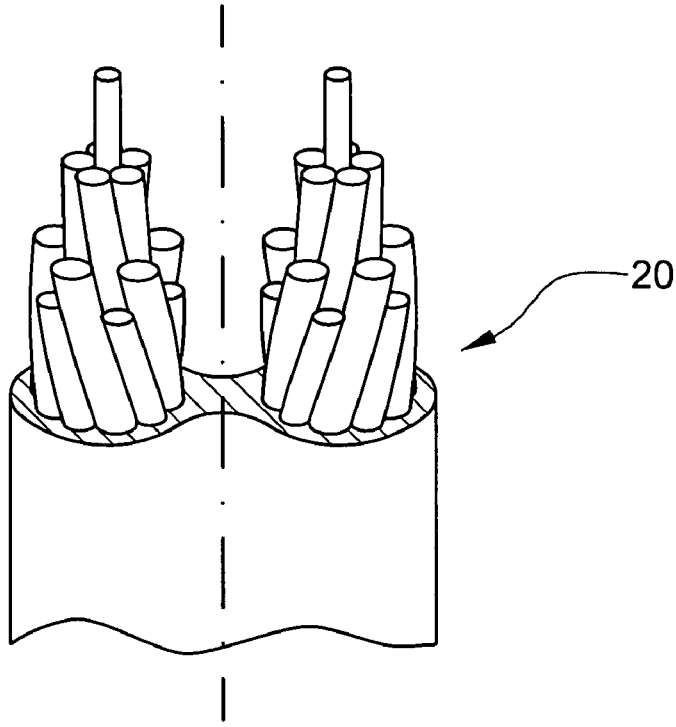
FIG. 5 is a perspective view of yet another embodiment of the invention.
Figure 6:
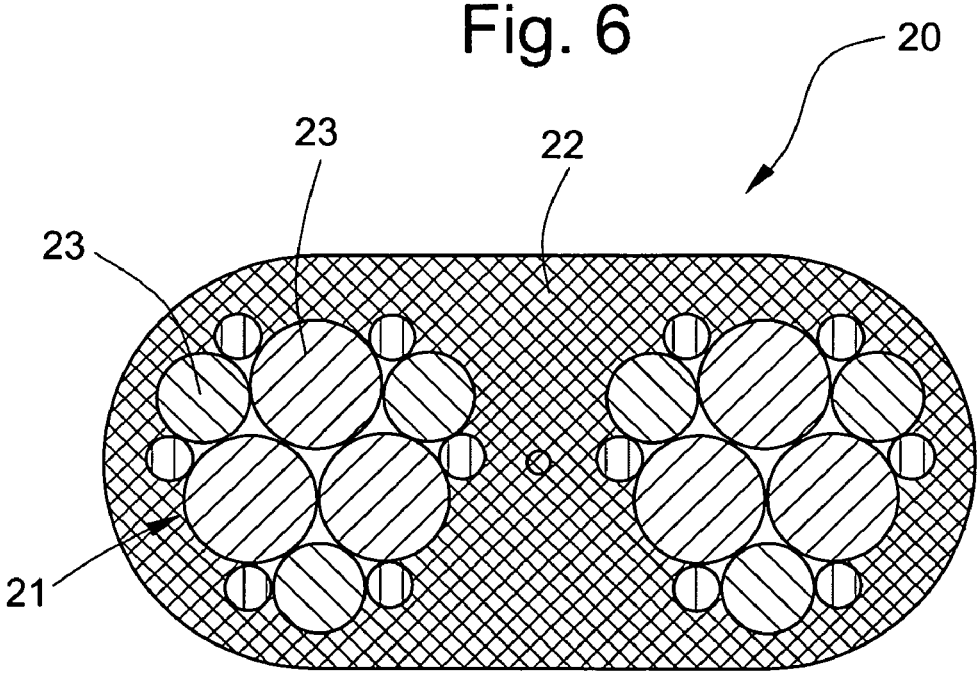
FIG. 6 is a cross-section through FIG. 5.
Figure 7:
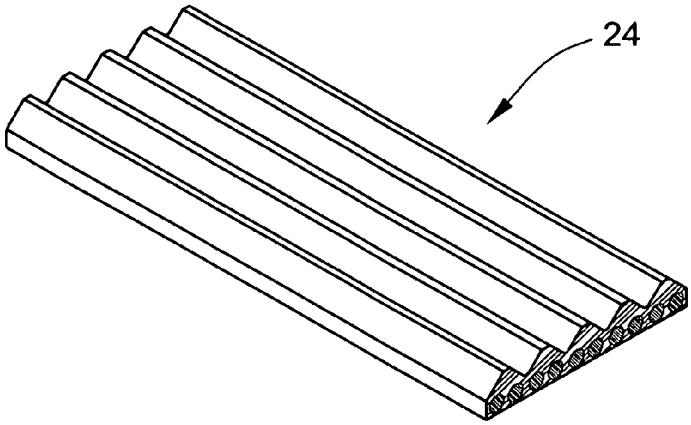
FIG. 7 is a perspective view of a further embodiment of the invention.
Figure 8:
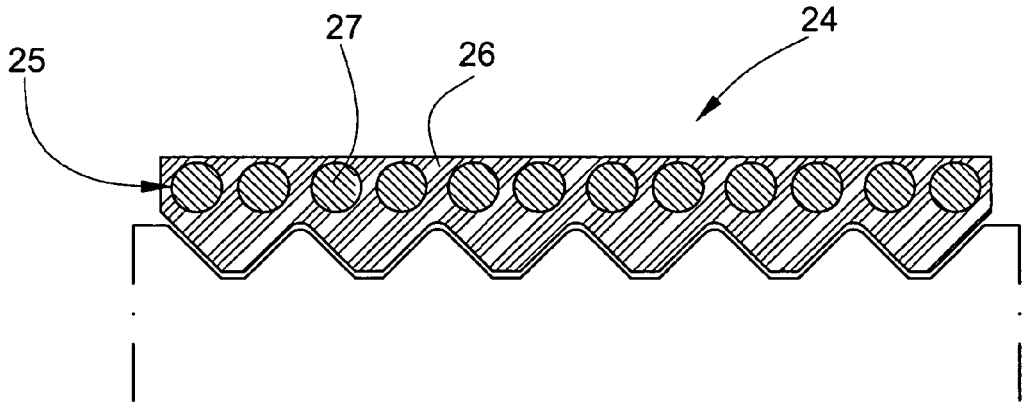
FIG. 8 is a cross-section through FIG. 7.

A first object of the present invention is to provide a drive-capable support or traction means (1, 9, 20, 24) with at least one layer of strands (2, 3; 10, 11; 21; 25) of synthetic fiber material and an outer casing (4; 12; 22; 26) which encases the support or traction means (1, 9, 20, 24), in which wear of the support or traction means (1, 9, 20, 24) is reduced and in which the entry of disadvantageous effects like heat development, prematurely occurring stiction and twisting of the support or traction means at higher traction forces is deflected.

A further object of the present invention is to provide a drive-capable support or tension means (1, 9, 20, 24) which allows maximum functionality with minimum diameter.

The fulfilment of these objects is to be compatible with current and proven methods for the production of drive-capable support or traction means (1, 9, 20, 24).

Pursuant to these objects, and others which will become apparent hereafter, one aspect of the present invention resides in selectively incorporating a lubricant in a drive-capable support or traction means (1, 9, 20, 24) in such a manner that the lubricant is admixed as dry lubricant with an impregnant of the strands (5, 6; 13, 14; 23; 27) and/or the lubricant is admixed with a material of the outer casing (4; 12; 22; 26) and/or the lubricant is applied as wet lubricant to at least one outer surface of the strands (5, 6; 13, 14; 23; 27) and/or the lubricant is admixed with the material of an intermediate casing (15) and/or the lubricant is applied to an intermediate casing (15).

Advantageously the outer casing (4; 12) accepting traction forces and the strands (5, 6; 13, 14) accepting traction forces are lubricated by way of lubricant in direct mutual contact. This direct mutual contact of outer casing (4; 12) and strands (5; 13) takes place according to first contact regions (7; 16) by a fixed connection, preferably in material couple. Advantageously a. melting of the outer casing (4; 12) with strands takes place at least regionally in the first contact region (7; 16). Advantageously such a melting of the outer casing (4; 12) with strands is carried out during extrusion of the outer casing (4; 12) onto the strands (5; 13), wherein matrix material of the strands (5; 13) is melted on. The matrix material of the strands (5; 13) advantageously has at least one additive to assist the material couple. For example, such an additive lowers the melting point of the matrix material of the strands (5; 13). Through this fixed connection between the outer casing (4; 12) and the strands (5; 13), traction forces from the drive pulley can be effectively introduced into the strands (5; 13) without giving rise to a disadvantageous heat development or prematurely occurring stiction. In the case of support or traction means with several strand layers (2, 3; 10, 11) the first contact regions (7; 16) extend between the outer casing (4; 12) and strands (5; 13) of an outer strand layer (2; 10).

Advantageously first contact regions (7; 16) between the outer casing (4; 12) and the strands (5; 13) are free of lubricant at least at the instant of application of the outer casing (4; 12).

Advantageously the strands (5, 6; 13, 14) accepting traction forces are in direct contact, lubricated by way of lubricant, with one another. This direct mutual contact of the strands (5, 6; 13, 14) takes place in accordance with second contact regions (8; 17). By contrast to U.S. Pat. No. 5,881,843, the use of strand casings is avoided. Advantageously the strands (5, 6; 13, 14) are lubricated for a movement relative to one another with a selectable coefficient of friction. The coefficient of friction between strands (5, 6; 13, 14) is selected to be sufficiently low so that the strands (5, 6; 13, 14) during bending at the drive pulley can execute a relative movement without a disadvantageous cable twisting taking place. A disadvantageous displacement or compression of strands (5; 13), which are in contact with the outer casing (4; 12), is thus avoided. In the case of support or traction means with several strand layers (2, 3; 10, 11), second contact regions (8; 17) are disposed not only in outer strand layers (2; 10), but also in inner strand layers (3; 11).

Advantageously in the case of use of several strand layers (10, 11) there is a separation of at least one outer strand layer (10) and one inner strand layer (11) by at least one intermediate casing (15) . The intermediate casing (15) increases the torsional stiffness of the support or traction means (9) . The intermediate casing (15) and the strand layers (13, 14) are in direct contact, lubricated by way of lubricant, with one another. The direct mutual contact of the intermediate casing (15) and the outer strand layer (10) takes place in accordance with third contact regions (18) and the direct mutual contact of the intermediate casing (15) and the inner strand layer (11) takes place in accordance with fourth contact regions (19).

Advantageously PU and/or polyester is used as the material of the outer or intermediate casing (12, 15). Advantageously the casing (12, 15) completely encloses the strands.

In a first preferred embodiment, third and fourth contact regions (18, 19) between the intermediate casing (15) and the outer (10) and inner (11) strand layers are lubricated for a movement relative to one another with a selectable coefficient of friction. Advantageously the coefficient of friction between the strands (13, 14) or between the strands (13, 14) and the intermediate casing (15) is in the region of 0.01 and 0.60. Advantageously the coefficient of friction between strands (13, 14) and the intermediate casing (15) is higher by at least 0.05, preferably 0.10, than that between the strands (13, 14) . Thus, under the action of external forces on the support or traction means (9) a relative movement of the strands (13, 14) is facilitated in a targeted manner and a relative movement between inner strand layers (11) and the intermediate casing (15) is made more difficult in a targeted manner.

In a further preferred embodiment, third contact regions (18) between the intermediate casing (15) and the outer strand layers (10) are lubricated for movement relative to one another with a selectable coefficient of friction, while fourth contact regions (19) between the intermediate casing (15) and the inner strand layer (11) are fixedly connected and advantageously are disposed in material couple relative to one another. This takes place, analogously to the fixed connection of the outer casing (12) relative to the outer strand layer (10), advantageously by melting together the intermediate casing (15) and the inner strand layer (11), for example during extrusion of the intermediate casing (15) on the inner strand layer (11), wherein matrix material of the strands (14) of the inner strand layer (11) is melted on at least regionally. Advantageously the coefficient of friction between the strands (13, 14) or between the strands (13, 14) and the intermediate casing (15) is in the region of 0.01 and 0.60. Advantageously the coefficient of friction between the intermediate casing (15) and the outer strand layer (10) is higher by at least 0.05, preferably 0.10, than that between the strands (13, 14) . Due to the fixed connection between the intermediate casing (15) and the inner strand layer (11) a movement of the strands (13, 14) relative to one another is made easier in a targeted manner under the action of external forces on the support or traction means (9), a relative movement between the outer strand layer (10) and the intermediate casing (15) is made more difficult in a targeted manner and a relative movement between the intermediate casing (15) and the inner strand layer (11) is prevented in a targeted manner.

The support or traction means (1; 9; 20; 24) consists of synthetic fiber material in the embodiment of cables as single (1; 9) or double cables (20), flat belts (24), cogged belts or poly V-belts.

By the designation support or traction means there is meant not only a support means, but also a traction means. A support means in the field of elevators carries the weight of the cage, a nominal load and a counterweight. For example, the cage and the counterweight hang by way of a cable or belt as support means at a deflecting roller arranged in the shaft head. A traction means in the field of elevators accepts, from a drive, traction forces for moving the cage and the counterweight. For example, a cable belt driven by a drive pulley is the traction means. The support means itself does not have to be driven, for example various support and traction means are provided in an elevator. The support or traction means is loaded in bending and tension at the deflecting roller or drive pulley.

Synthetic means that the cable or the belt contains means, produced solely by extrusion, for accepting the traction forces. Advantageously aramid is used as the fiber material. Aramid has about twice as small a modulus of elasticity as steel, the elastic extension due to traction force being correspondingly higher. In addition, aramid is an anisotropic material, the aramid fibers being loadable in transverse direction less than in longitudinal direction by at least a factor of 10. Advantageously the strands of aramid are impregnated with an impregnant such as a PU solution. Fiber material and impregnant form the matrix material of the strands. For example, impregnation is in a ratio of 1/3 aramid to 2/3 PU solution and with substantially constant density.

The support or traction means is driven by axles, drive pulleys or gearwheels by friction couple or mechanically positive couple.

Advantageously a dry lubricant is admixed with the impregnant before impregnation of the filaments and/or a dry lubricant is admixed with the material for the outer or intermediate casing and/or a wet lubricant is applied to strands.

Talcum, graphite powder, molybdenum disulfide, polytetrafluorethylene (PTFE), lead (Pb), gold (Au), silver (Ag), boron trioxide ($BO_3$), lead oxide (PbO), zinc oxide (ZnO), copper oxide (Cu2O), molybdenum trioxide ($MoO_3$) and titanium dioxide ($TiO_2$) are suitable as dry lubricant.

Animal, plant, petrochemical and synthetic oil or grease, glycerol, polybutane, polymer ester, polyolefines, polyglycols, silicon, soap, natural or synthetic waxes, resins and tars with additives of organic and/or inorganic thickeners, such as, for example, organic polymers, polycarbamide, metal soap, silicates, metal oxides, silicic acid, organophilic betonite, etc., are suitable as wet lubricant. With knowledge of the present invention the expert can use other known lubricants as well as mixtures of known lubricants.

Advantageously the lubricant is viscous in such a manner that in the support or traction means it moves only slightly or not at all. Advantageously the lubricant is a sufficiently large molecule so that it cannot escape through the outer casing from the support or traction means. Such a teaching of a support or traction means with strands of synthetic fibre material stands in contrast to traditional teachings of steel cables, where thin-bodied oils or greases for reducing the coefficient of friction between steel strands are provided in the interior of the steel cable, while adhesive resins for increasing the coefficient of friction between steel cable and drive pulley are provided on the outer side of the steel cable.

While the invention has been illustrated and described above, it is not intended to be limited to the details shown since various modifications and structural changes may be made without departing in any way from the spirit of the present invention.

Without further analysis, the foregoing will so fully reveal the gist of the present invention that others can, by applying current knowledge, readily adapt various applications without omitting features that, from the standpoint of prior art, merely constitute essential characteristics of the generic or specific aspects of this invention.

What is claimed is:

1. A drive-capable support or traction member, comprising: at least one layer of strands of synthetic fiber material; an outer casing which encases the strands, first contact regions between the outer casing and the strands that form a fixed connection between the outer casing and the strands; and a lubricant selectively incorporated into second contact regions between strands so as to reduce a coefficient of friction, said lubricant being admixed with an impregnant of the strands.

2. A drive-capable support or traction member, comprising: at least one layer of strands of synthetic fiber material; an outer casing which encases the strands, first contact regions between the outer casing and the strands that form a fixed connection between the outer casing and the strands; and a lubricant selectively incorporated into second contact regions between strands so as to reduce a coefficient of friction, said lubricant being a sufficiently large molecule so that it cannot escape through the outer casing.

3. A drive-capable support or traction member, comprising: at least one layer of strands of synthetic fiber material, an outer casing which encases strands; an intermediate casing which encases strands, the outer casing and the strands having first contact regions that form a fixed connection between the outer casing and strands; and lubricant selectively incorporated into second contact regions between strands so as to reduce a coefficient of friction, third contact regions being formed between the intermediate casing and an outer strand layer, said lubricant increasing the coefficient of friction in said third contact regions, and fourth contact regions being formed between the intermediate casing and an inner strand layer, said lubricant increasing the coefficient of friction in the fourth contact regions.

4. A drive-cable support or traction member according to claim 3, wherein the fourth contact regions are lubricated by admixing lubricant with a material of the intermediate casing and/or applying lubricant to the intermediate casing.

5. A drive-capable support or traction member, comprising: at least one layer of strands of synthetic fiber material; an outer casing which encases strands; an intermediate casing which encases strands, the outer casing and the strands having first contact regions that form a fixed connection between the outer casing and strands, the intermediate casing and an inner strand layer having fourth contact regions that form a fixed connection between the intermediate casing and the inner strand layer; and lubricant selectively incorporated into second contact regions between strands so as to reduce a coefficient of friction, third contact regions being formed between the intermediate casing and an outer strand layer, said lubricant increasing the coefficient of friction in the third contact regions.

6. A drive-cable support or traction member according to claim 3, wherein the second regions are lubricated by admixing lubricant with an impregnant of the strands and/or applying lubricant to at least one outer surface of the strands.

7. A drive-cable support or traction member according to claim 5, wherein the second regions are lubricated by admixing lubricant with an impregnant of the strands and/or applying lubricant to at least one outer surface of the strands.

8. A drive-cable support or traction member according to claim 3, wherein the third regions are lubricated by admixing lubricant with a material of the intermediate casing and/or applying lubricant to the intermediate casing.

9. A drive-cable support or traction member according to claim 5, wherein the third regions are lubricated by admixing lubricant with a material of the intermediate casing and/or applying lubricant to the intermediate casing.

10. A drive-capable support or traction member according to claim 1, wherein the lubricant is a dry lubricant and/or a wet lubricant.

11. A drive-capable support or traction member according to claim 2, wherein the lubricant is a dry lubricant and/or a wet lubricant.

12. A drive-capable support or traction member according to claim 3, wherein the lubricant is a dry lubricant and/or a wet lubricant.

13. A drive-capable support or traction member according to claim 5, wherein the lubricant is a dry lubricant and/or a wet lubricant.

14. A drive-capable support or traction member according to claim 10, wherein said lubricant is a sufficiently large molecule so that it cannot escape through the outer casing.

15. A drive-capable support or traction member according to claim 12, wherein said lubricant is a sufficiently large molecule so that it cannot escape through the outer casing.

16. A drive-capable support or traction member according to claim 13, wherein said lubricant is a sufficiently large molecule so that it cannot escape through the outer casing.

17. A drive-capable support or traction member according to claim 1, wherein at least one of:

the outer casing and the strands are melted together at least regionally in first contact regions;

a matrix material of the strands has at least one additive to assist a material bond; and the outer casing is melted with the matrix material of the strands at least regionally in the first contact regions.

18. A drive-capable support or traction member according to claim 3, wherein at least one of:

the outer casing and the strands are melted together at least regionally in first contact regions;

a matrix material of the strands has at least one additive to assist a material bond; and the outer casing is melted with the matrix material of the strands at least regionally in the first contact regions.

19. A drive-capable support or traction member according to claim 5, wherein at least one of:

the outer casing and the strands are melted together at least regionally in first contact regions;

a matrix material of the strands has at least one additive to assist a material bond; and the outer casing is melted with the matrix material of the strands at least regionally in the first contact regions.

20. A drive-capable support or traction member according to claim 5, wherein at least one of:

the intermediate casing and the strands in the fourth contact regions are melted together at least regionally;

a matrix material of the strands has at least one additive to assist a material bond; and the intermediate casing is melted with the matrix material of the strands at least regionally in the fourth contact regions.

21. A drive-capable support or traction member according to claim 20, wherein at least one of:

the outer casing and the strands are melted together at least regionally in the first contact regions;

a matrix material of the strands has at least one additive to assist a material bond; and the outer casing is melted with the matrix material of the strands at least regionally in first contact regions.

22. A drive-capable support or traction member according to claim 1, wherein the member is one of a single cable, a double cable, a flat belt, a cogged belt, and a poly V-belt.

23. A drive-capable support or traction member according to claim 2, wherein the member is one of a single cable, a double cable, a flat belt, a cogged belt, and a poly V-belt.

24. A drive-capable support or traction member according to claim 3, wherein the member is one of a single cable, a double cable, a flat belt, a cogged belt, and a poly V-belt.

25. A drive-capable support or traction member according to claim 5, wherein the member is one of a single cable, a double cable, a flat belt, a cogged belt, and a poly V-belt.

26. A method of manufacturing a drive-capable support or traction member having at least one layer of strands of synthetic fiber material and an outer casing which encases the strands, the method comprising the steps of: providing at least one layer of strands of synthetic fiber material; encasing the strands with an outer casing whereby a fixed connection is formed in first contact regions between the outer casing and the strands; and selectively incorporating lubricant into second contact regions between the strands so as to reduce a coefficient of friction between the strands in the second contact region.

27. A method according to claim 26, including using at least one of a wet lubricant and a dry lubricant.

28. A method according to claim 27, wherein the dry lubricant is at least one of the group consisting of talcum, graphite powder, molybdenum disulfide, polytetrafluorethylene, lead, gold, silver, boron trioxide, lead oxide, zinc oxide, copper oxide, molybdenum trioxide, and titanium dioxide.

29. A method according to claim 27, wherein the wet lubricant is at least one of the group consisting of animal oil, plant oil, petrochemical oil, synthetic oil or grease, glycerol, polybutane, polymer ester, polyolefines, polyglycols, silicon, soap, natural waxes, resins or tars, and synthetic waxes, resins or tars.

30. A method according to claim 27, wherein the wet lubricant includes additives of at least one of organic and inorganic thickeners.

31. A method according to claim 30, wherein the additives are at least one of the group consisting of organic polymers, polycarbamides, metal soap, silicates, metal oxides, silicic acid, and organophilic betonite.

* * * * *